US008904744B1

(12) United States Patent
Cipolla

(10) Patent No.: US 8,904,744 B1
(45) Date of Patent: Dec. 9, 2014

(54) METHOD OF FORMING A BEAD CHAIN

(71) Applicant: Steven A. Cipolla, Warwick, RI (US)

(72) Inventor: Steven A. Cipolla, Warwick, RI (US)

(73) Assignee: National Chain Company, Warwick, RI (US)

( * ) Notice: Subject to any disclaimer, the term of this patent is extended or adjusted under 35 U.S.C. 154(b) by 0 days.

(21) Appl. No.: 14/197,495

(22) Filed: Mar. 5, 2014

(51) Int. Cl.
*F16G 13/12* (2006.01)
*B21L 11/00* (2006.01)
*B21L 11/12* (2006.01)

(52) U.S. Cl.
CPC ..... *B21L 11/12* (2013.01)
USPC ..... 59/2; 59/13; 59/18; 59/31; 59/35.1

(58) Field of Classification Search
USPC ..... 59/1, 2, 13, 15, 18, 22, 31, 35.1
See application file for complete search history.

(56) References Cited

U.S. PATENT DOCUMENTS 1,947,113 A * 2/1934 Russell ..... 59/35.1
6,532,766 B1 3/2003 Chia et al.
6,557,376 B2 5/2003 Pratt
7,036,339 B1 5/2006 Chia et al.
7,409,763 B2 8/2008 Pratt
7,716,911 B2 * 5/2010 Namiki et al. ..... 59/2

FOREIGN PATENT DOCUMENTS

WO 2006/091418 8/2006

* cited by examiner

*Primary Examiner* — David B Jones
(74) *Attorney, Agent, or Firm* — Salter & Michaelson

(57) ABSTRACT

The method includes providing a source of flat stock; forming the flat stock into a spherical shaped bead that includes connected semi-spherical bead halves with each half having opposed open recesses that are located in a circular edge that defines each semi-spherical half; providing a source of wire stock; forming the wire stock into a series of the interconnected links with each link having a middle section and contiguous opposed enlarged ends at respective ends of the middle section; positioning the formed links each between adjacently disposed spherical shaped beads for accommodation in facing recesses thereof; closing the connected semi-spherical bead halves to form the spherical shaped bead; and laser welding between the connected semi-spherical bead halves.

20 Claims, 4 Drawing Sheets

METHOD OF FORMING A BEAD CHAIN

FIELD OF THE INVENTION

The present invention relates in general to a method of forming a bead chain. More particularly, the present invention pertains to an improved method for providing a secure interlock at links between the beads of the chain.

BACKGROUND OF THE INVENTION

There are various types of chains that are constructed including as part of the chain construction a series of interlocked beads. However, one of the problems associated with the present bead chains is that the interlocking is not effective and thus many times the chain can be broken too easily. This breaking of the chain typically occurs at a link between beads.

Accordingly, it is an object of the present invention to provide an improved method of forming a bead chain in which the individual beads are more firmly interlocked.

SUMMARY OF THE INVENTION

To accomplish the foregoing and other objects, features and advantages of the present invention there is provided a method of forming a bead chain that is comprised of successive individual beads that are coupled together by means of interconnecting links. The method of the present invention comprises the steps of:

providing a source of flat stock;

forming the flat stock into a spherical shaped bead that includes connected semi-spherical bead halves with each half having opposed open recesses that are located in a circular edge that defines each semi-spherical half;

providing a source of wire stock;

forming the wire stock into a series of the interconnected links with each link having a middle section and contiguous opposed enlarged ends at respective ends of the middle section;

positioning the formed links each between adjacently disposed spherical shaped beads for accommodation in facing recesses thereof;

closing the connected semi-spherical bead halves to form the spherical shaped bead;

and laser welding between the connected semi-spherical bead halves.

In accordance with other aspects of the present invention the step of forming the wire stock into a series of the interconnected links is performed concurrently with the step of forming the flat stock into a spherical shaped bead; including forming each of the opposed open recesses as an open semi-circular recess; including dimensioning the middle section of each link so as to have a length comparable to the spacing between opposed recesses of a semi-spherical bead half; including positioning each link so that each opposed enlarged end thereof engages on an inside of the circular edge of adjacent semi-spherical halves; including positioning each link so that only the middle section thereof is disposed between adjacent semi-spherical halves; the step of forming the wire stock into a series of the interconnected links includes forming the wire stock in a dumbbell configuration; the step of forming the flat stock into a spherical shaped bead includes connecting the semi-spherical bead halves with a hinge connection; the step of closing the connected semi-spherical bead halves includes pivoting the halves at the hinge connection so that facing circular edges of any one bead so formed are engaged in the closed position; the step of laser welding includes laser welding at a position opposite to the hinge connection; the step of closing the connected semi-spherical bead halves by pivoting the halves at the hinge connection provides a congruent fit between the semi-spherical bead halves; the step of closing the connected semi-spherical bead halves by pivoting the halves at the hinge connection provides circular contact joined edges; the step of laser welding includes laser welding at a position opposite to the hinge connection by laser welding at and across the circular contact joined edges; the steps of forming the flat stock and wire stock includes concurrently progressing the flat stock and wire stock in a forming direction; the steps of forming the flat stock and wire stock includes forming adjacently disposed and spaced apart connected semi-spherical bead halves; the spaced apart connected semi-spherical bead halves are formed with each half having the opposed open recesses that are located in the circular edge that defines each semi-spherical half; the step of forming the flat stock into a spherical shaped bead includes connecting the semi-spherical bead halves with a joined hinge connection; the step of closing the connected semi-spherical bead halves includes pivoting the halves at the hinge connection so that facing circular edges of any one bead so formed are engaged in the closed position; the pivoting is in a direction orthogonal to the forming direction; and including forming each of the opposed open recesses as an open semi-circular recess, dimensioning the middle section of each link so as to have a length comparable to the spacing between opposed recesses of a semi-spherical bead half, positioning each link so that each opposed enlarged end thereof engages on an inside of the circular edge of adjacent semi-spherical halves, positioning each link so that only the middle section thereof is disposed between adjacent semi-spherical halves, and positioning each link to extend in the forming direction between adjacently disposed formed beads.

BRIEF DESCRIPTION OF THE DRAWINGS

It should be understood that the drawings are provided for the purpose of illustration only and are not intended to define the limits of the disclosure. In the drawings depicting the present invention, all dimensions are to scale. The foregoing and other objects and advantages of the embodiments described herein will become apparent with reference to the following detailed description when taken in conjunction with the accompanying drawings in which.

DETAILED DESCRIPTION

Figure 1:
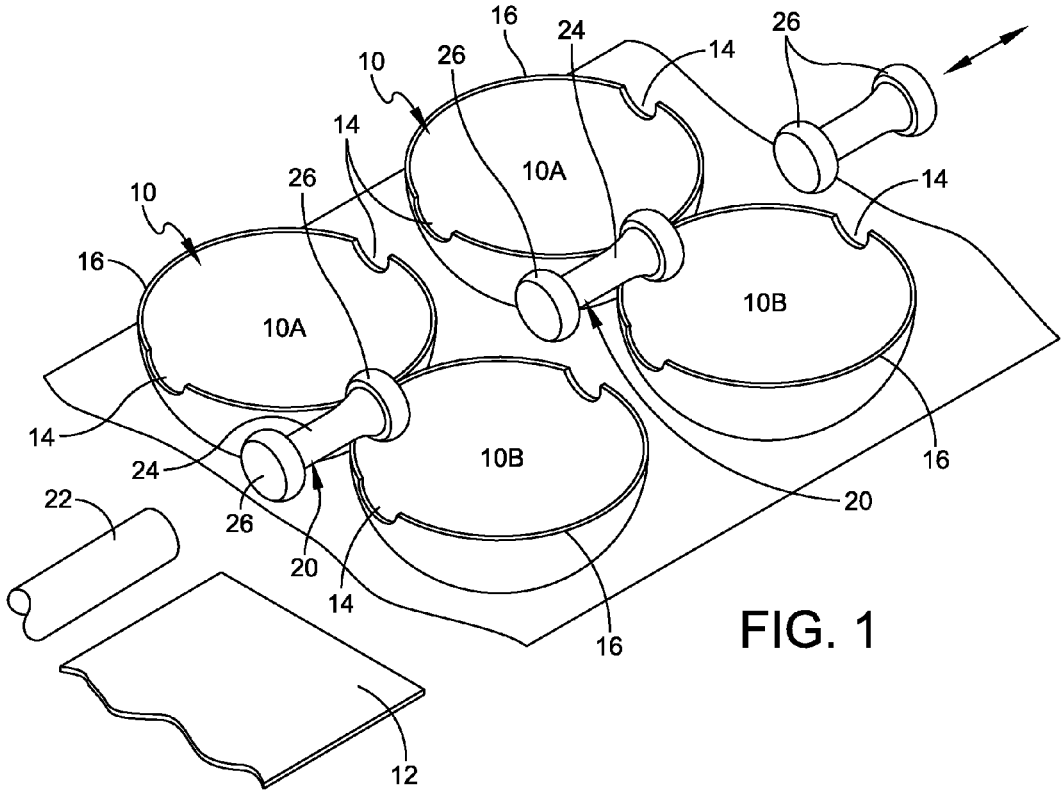
FIG. 1 is a schematic perspective view showing one step in the forming of the bead chain of the present invention.

In accordance with the present invention there is provided a method of forming a bead chain that is comprised of successive individual beads that are coupled together by means of interconnecting links. For a description of the method of the present invention, refer to drawings and in particular FIGS. 1-6. In the drawings the bead is identified by the reference number 10 and each link is identified by the reference number 20.

In accordance with the method of the present invention, there is provided a source of flat stock 12 and also a source of wire stock 22. The flat stock 12 is adapted to be passed through a machine (not shown) at the same time that the wire stock or core wire 22 passes through the machine. The flat stock 12 is formed into a spherical-shaped bead that includes connected semi-spherical bead halves 10A and 10B. At the same time the wire stock is formed into a dumbbell shape that is meant to be locked with each bead forming the aforementioned link 20.

Figure 2:
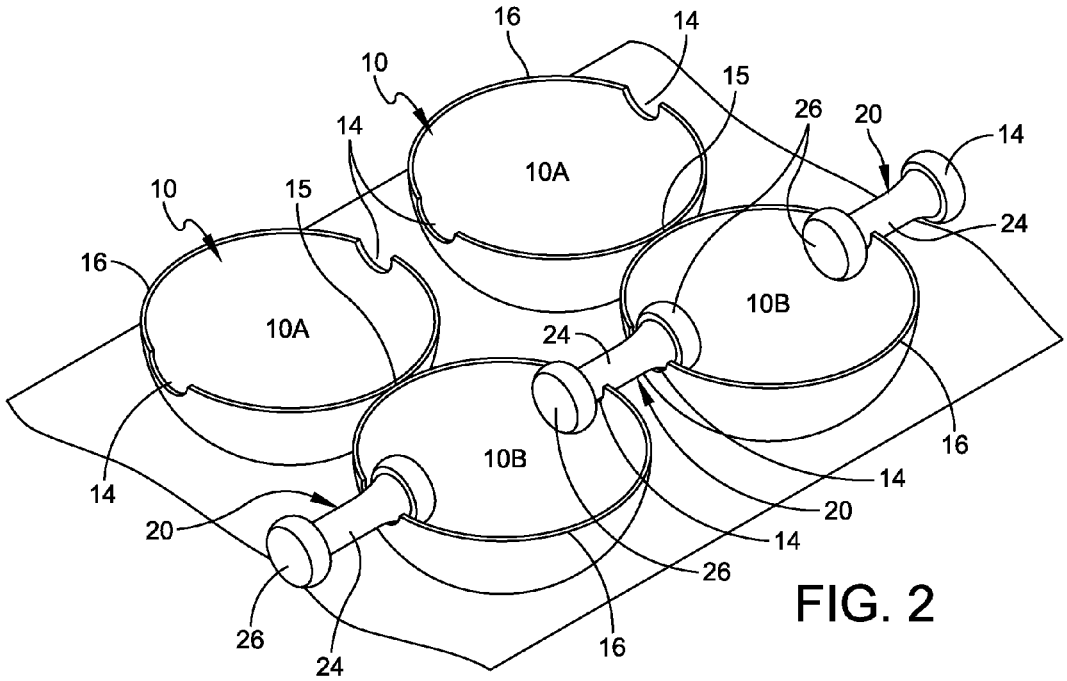
FIG. 2 is a perspective view illustrating a further step in the method of the present invention.

Each of the bead halves 10A and 10B have opposed open recesses 14 that are located in a circular edge 16 that defines each semi-spherical half. Similarly, the wire stock 22 is formed into interconnected links 20 with each link having a middle section 24 and contiguous opposed enlarged ends 26 at respective ends of the middle section 24. Each of the formed links 20 end up positioned between adjacent disposed spherical shaped beads and are arranged in facing recesses. FIG. 2 illustrates a center link 24 disposed in facing recesses of adjacently disposed bead halves 10B.

Figure 3:
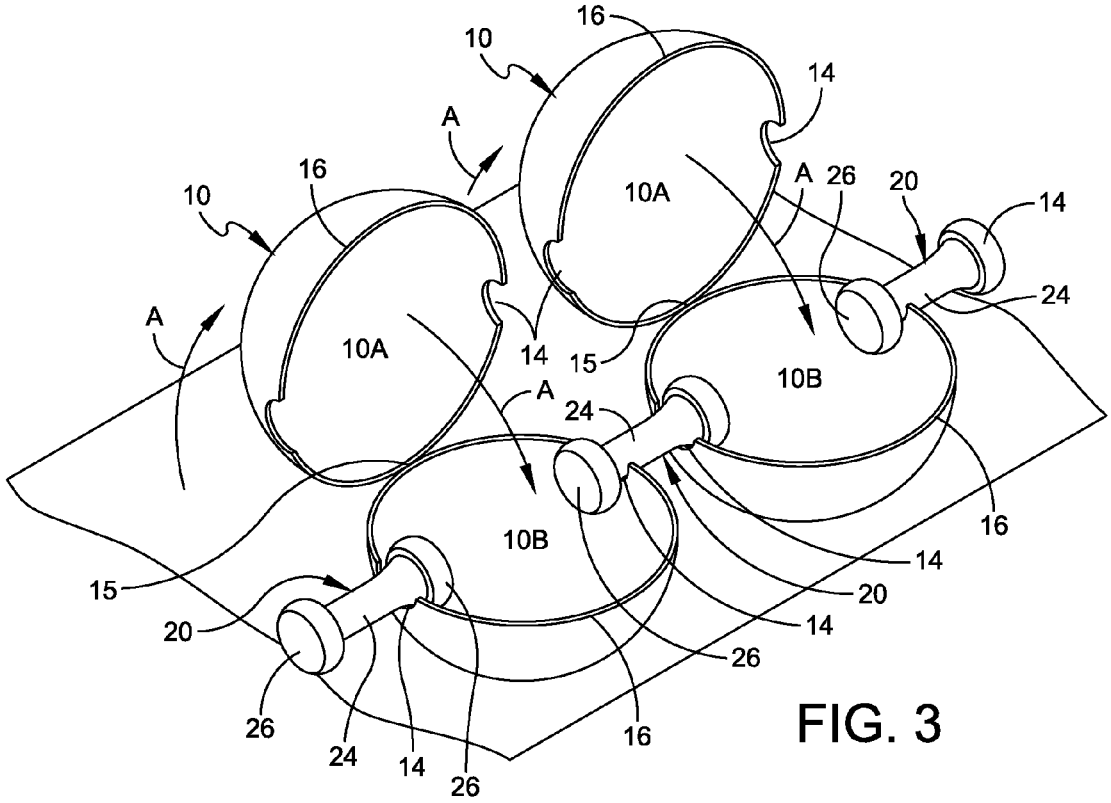
FIG. 3 is a perspective view illustrating still a further step in accordance with the method of the present invention.
Figure 4:
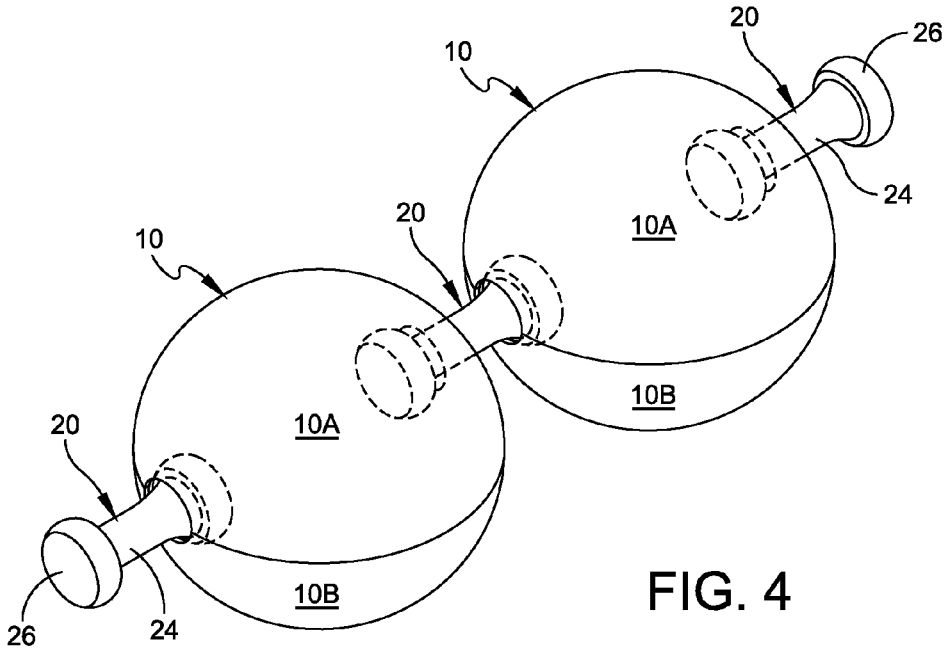
FIG. 4 is a perspective view schematically illustrating two beads of a bead chain linked together.

Reference is now made to FIG. 3 which shows a next step of closing the connected semi-spherical bead halves 10A, 10B to form the spherical-shaped bead illustrated in FIG. 4. The forming of the wire stock into a series of interconnected links is preferably concurrently performed with the step of forming the flat stock into the spherical-shaped bead. As illustrated in the drawings, each of the opposed open recesses 14 is preferably in the form of a semi-circular recess (half circle). The dimension of the middle section 24 of each link is such as to have a length between the ends 26 that is comparable to the distance or length between the opposed recesses 14 of adjacently disposed semi-spherical bead halves such as illustrated in FIG. 3 at the bead halves 10B. Each of the links is preferably positioned so that each opposed enlarged end thereof engages on an inside of the circular edge of adjacently disposed semi-spherical halves. Thus, only the middle section of the link is positioned between adjacently disposed semi-spherical halves with the enlarged ends 26 anchored inside of respective adjacently disposed semi-spherical halves.

As noted in FIGS. 1-3, the halves 10A and 10B remain interconnected at a hinge location 15. This hinge location 15 may be in the form of a living hinge created by having a remaining portion between the halves still interconnected while at the same time allowing a hinging action such as in the direction of arrows A in FIG. 3. Thus, the step of closing the bead halves includes pivoting the halves at this hinge connection 15 so that facing circular edges 16 are engaged in the closed position. This fully closed position is illustrated in FIG. 4.

Figure 5:
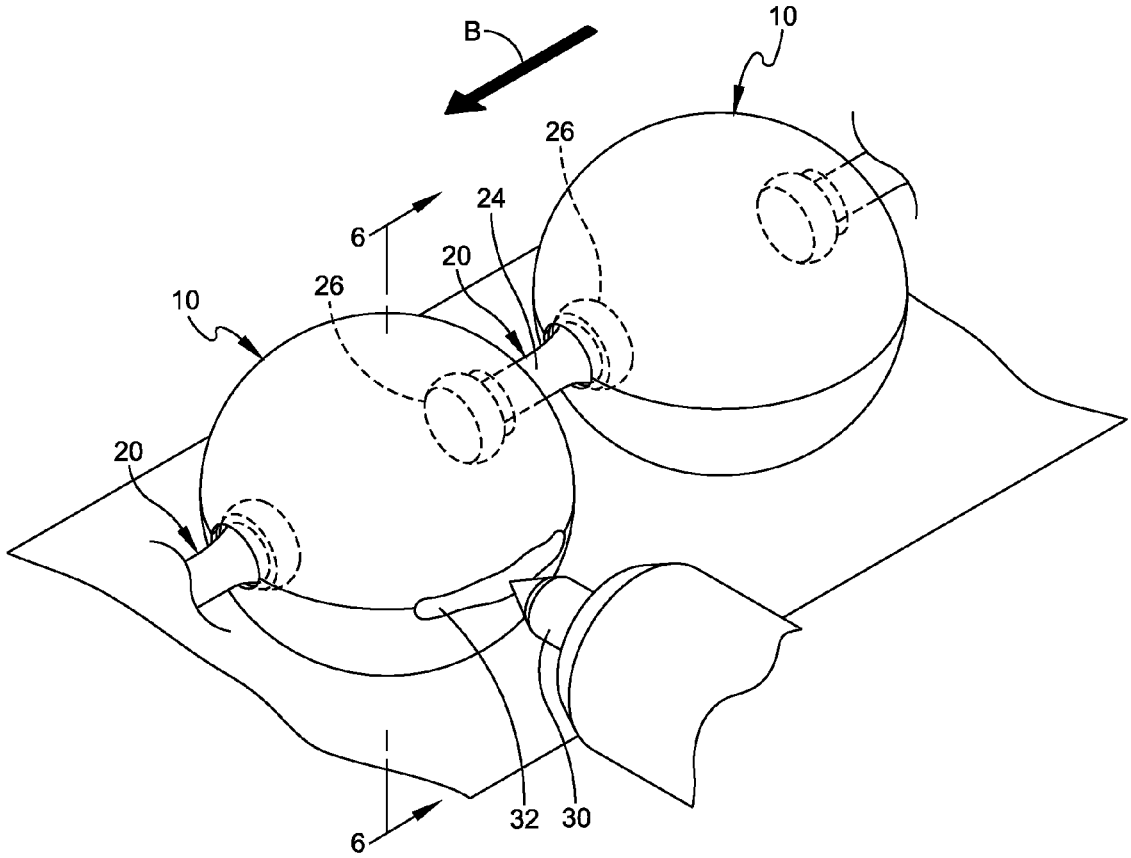
FIG. 5 is a perspective view of the step of laser welding halves of the bead as one of the steps in the method of the present invention.

In order to complete the securing of the links and beads, reference is also now made to FIG. 5 which depicts the step of laser welding which includes a welding tip 30 to provide a weld area depicted at 32 in FIG. 5. This laser welding step may occur successively at each bead as the formed beads and links progress in the direction of arrow B in FIG. 5.

Thus, the step of closing the connected semi-spherical bead halves by pivoting the halves at the hinge connection provides a congruent fit between the semi-spherical bead halves so that a completed and accurately-shaped spherical bead is formed. This thus provides a circular contact region where weld 32 occurs. In FIG. 5 the weld area 32 is shown as relatively wide for illustration purposes but may simply be in the form of a single small spot weld. This weld area 32 is preferably at a position on the spherical bead that is opposite to the hinge connection 15.

Figure 6:
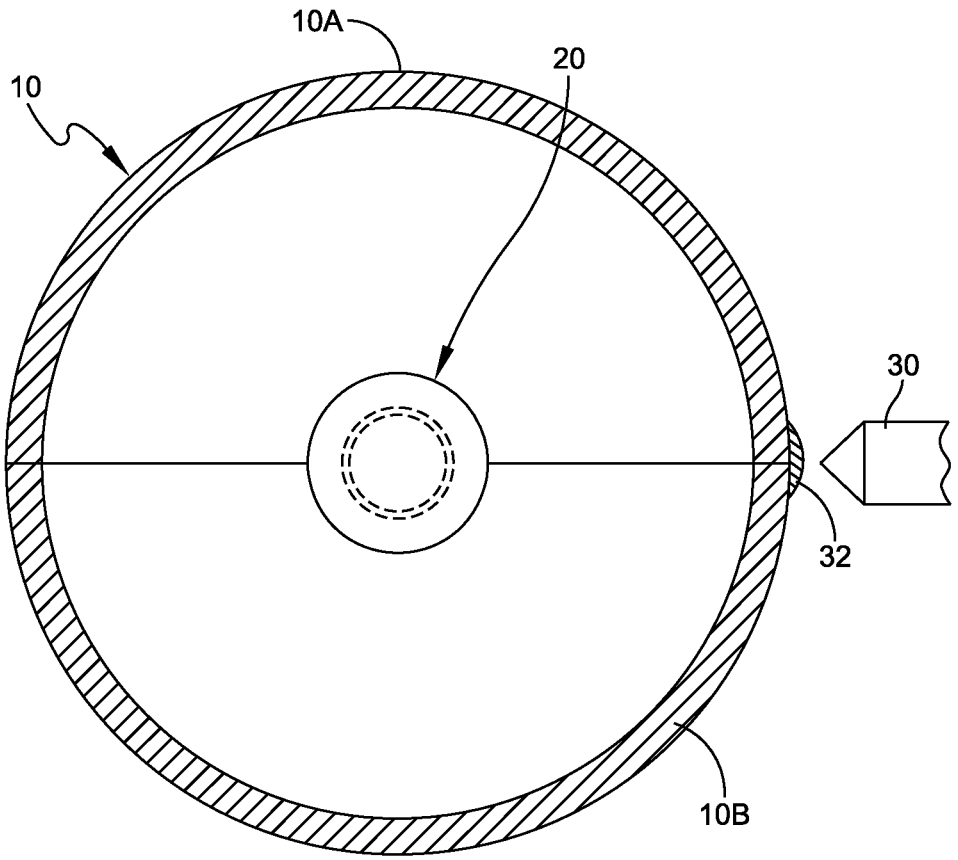
FIG. 6 is a cross-sectional view taken along line 6-6 of FIG. 5.

FIG. 6 is a cross-sectional view take lines 6-6 of FIG. 5. This cross-sectional view illustrates the bead 10 and bead halves 10A and 10B as well as the link at 20. FIG. 6 also illustrates the weld area 32 formed by means of the laser weld equipment including the laser welding tip 30. The laser welding apparatus is a well known apparatus and is thus not described in great detail herein. It is sufficient to say that a laser weld occurs by means of a piece of conventional apparatus. The welding preferably occurs on a selective basis at each of the beads as they progress past the welding head.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A method of forming a bead chain that is comprised of successive individual beads that are coupled together by means of interconnecting links, said method comprising the steps of:

providing a source of flat stock;

forming the flat stock into a spherical shaped bead that includes connected semi-spherical bead halves with each half having opposed open recesses that are located in a circular edge that defines each semi-spherical half;

providing a source of wire stock;

forming the wire stock into a series of the interconnected links with each link having a middle section and contiguous opposed enlarged ends at respective ends of the middle section;

positioning the formed links each between adjacently disposed spherical shaped beads for accommodation in facing recesses thereof;

closing the connected semi-spherical bead halves to form the spherical shaped bead;

and laser welding between the connected semi-spherical bead halves.

2. The method of claim 1 wherein the step of forming the wire stock into a series of the interconnected links is performed concurrently with the step of forming the flat stock into a spherical shaped bead.

3. The method of claim 1 including forming each of the opposed open recesses as an open semi-circular recess.

4. The method of claim 3 including dimensioning the middle section of each link so as to have a length comparable to the spacing between opposed recesses of a semi-spherical bead half.

5. The method of claim 4 including positioning each link so that each opposed enlarged end thereof engages on an inside of the circular edge of adjacent semi-spherical halves.

6. The method of claim 5 including positioning each link so that only the middle section thereof is disposed between adjacent semi-spherical halves.

7. The method of claim 6 wherein the step of forming the wire stock into a series of the interconnected links includes forming the wire stock in a dumbbell configuration.

8. The method of claim 1 wherein the step of forming the flat stock into a spherical shaped bead includes connecting the semi-spherical bead halves with a hinge connection.

9. The method of claim 8 wherein the step of closing the connected semi-spherical bead halves includes pivoting the halves at the hinge connection so that facing circular edges of any one bead so formed are engaged in the closed position.

10. The method of claim 9 wherein the step of laser welding includes laser welding at a position opposite to the hinge connection.

11. The method of claim 10 wherein the step of closing the connected semi-spherical bead halves by pivoting the halves at the hinge connection provides a congruent fit between the semi-spherical bead halves.

12. The method of claim 10 wherein the step of closing the connected semi-spherical bead halves by pivoting the halves at the hinge connection provides circular contact joined edges.

13. The method of claim 12 wherein the step of laser welding includes laser welding at a position opposite to the hinge connection by laser welding at and across the circular contact joined edges.

14. The method of claim 1 wherein the steps of forming the flat stock and wire stock includes concurrently progressing the flat stock and wire stock in a forming direction.

15. The method of claim 14 wherein the steps of forming the flat stock and wire stock includes forming adjacently disposed and spaced apart connected semi-spherical bead halves.

16. The method of claim 15 wherein the spaced apart connected semi-spherical bead halves are formed with each half having the opposed open recesses that are located in the circular edge that defines each semi-spherical half.

17. The method of claim 15 wherein the step of forming the flat stock into a spherical shaped bead includes connecting the semi-spherical bead halves with a joined hinge connection.

18. The method of claim 16 wherein the step of closing the connected semi-spherical bead halves includes pivoting the halves at the hinge connection so that facing circular edges of any one bead so formed are engaged in the closed position.

19. The method of claim 18 wherein the pivoting is in a direction orthogonal to the forming direction.

20. The method of claim 19 including forming each of the opposed open recesses as an open semi-circular recess, dimensioning the middle section of each link so as to have a length comparable to the spacing between opposed recesses of a semi-spherical bead half, positioning each link so that each opposed enlarged end thereof engages on an inside of the circular edge of adjacent semi-spherical halves, positioning each link so that only the middle section thereof is disposed between adjacent semi-spherical halves, and positioning each link to extend in the forming direction between adjacently disposed formed beads.

* * * * *